US006279271B1

(12) United States Patent
Burkart, Jr.

(10) Patent No.: US 6,279,271 B1
(45) Date of Patent: Aug. 28, 2001

(54) UNDER-DECK WATER SHEDDING SYSTEM

(76) Inventor: James A. Burkart, Jr., 2054 Chadds Ford Dr., Reston, VA (US) 20191

( * ) Notice: Subject to any disclaimer, the term of this patent is extended or adjusted under 35 U.S.C. 154(b) by 0 days.

(21) Appl. No.: 09/450,290

(22) Filed: Nov. 27, 1999

Related U.S. Application Data

(60) Provisional application No. 60/110,164, filed on Nov. 27, 1999.

(51) Int. Cl.[7] ..... E04D 13/00
(52) U.S. Cl. ..... 52/11; 52/14; 52/302.3
(58) Field of Search ..... 52/302.1, 302.3, 52/11, 14, 506.01

(56) References Cited

U.S. PATENT DOCUMENTS 3,253,375 * 5/1966 Takehara ..... 52/11 X
4,065,883 * 1/1978 Thibodeau ..... 52/11
4,817,343 * 4/1989 Rutledge ..... 52/22
4,860,502 * 8/1989 Mickelsen ..... 52/11
5,195,281 * 3/1993 Kosko ..... 52/11
5,729,931 * 3/1998 Wade ..... 52/12
5,765,328 * 6/1998 Moore ..... 52/302.1
6,164,019 * 12/2000 Salley ..... 52/11

* cited by examiner

*Primary Examiner*—Beth A. Stephan
*Assistant Examiner*—Brian E. Glessner

(57) ABSTRACT

This invention comprises a grid structure that with the addition of panels and panel holding components, and the further addition of a gutter and downspout provides an effective under-deck water shedding system where the grid and panel components generally are set or slid into place and generally can be lifted or slid out of place for adjustment, maintenance or removal.

15 Claims, 3 Drawing Sheets

UNDER-DECK WATER SHEDDING SYSTEM

CROSS-REFERENCES TO RELATED APPLICATIONS

This application claims the benefit of Provisional Application Ser. No. 60/110,164, filed Nov. 27, 1999.

BACKGROUND OF INVENTION

1. Field of Invention

Deck drainage systems.

2. Brief Summary of Invention

The invention can be briefly described as corrugated panels over a wooden grid, these supported at the high-side by a high-ledger and at the low-side by low-ledger, with guttering attached at the low-side.

PRIOR ART

Moore U.S Pat. No. 5,765,328, Mickelsen U.S. Pat. No. 4,860,502, Thibodeau U.S. Pat. No. 4,065,883 describe drainage systems which fit under decks between joists. These are difficult to install, unsightly, and would tend to clog up with debris. A traditional way of fastening panels directly to the bottom of joists and shims have the same problems.

OBJECTS AND ADVANTAGES

This invention protects property from precipitation, lingering moisture and wet deleterious conditions. It makes space more useable and comfortable affordable.

By its modularity the preferred embodiment of this invention enhances ease of fabrication and installation, and enhances the feasibility of pre-manufacturing the system as a kit for installation by homeowners.

It aesthetically enhances appearances under existing decks. It is unobtrusive because of its hidden and sleek components.

Its unobtrusiveness and aesthetic appeal enhances the ability to obtain permission for use in communities under strict design covenants.

The preferred implementation is not classified as structural—thereby not requiring building permits, in Fairfax County, Va., one of the more highly regulated Counties in the United States. (Having to obtain permits can involve a lot of time and cost, making a good product unmarketable.)

The preferred implementation can be taken apart and reinstalled due to bolt and screw fastening means and the snap/gravitational holding means as well as its light-weight. This can be useful in situations when a deck is rebuilt or the installation of the implementation is moved from one deck to another.

The preferred implementation is easy to maintain, due to its holding means, most members can be easily lifted, unsnapped, slid or otherwise temporarily displaced from position without requiring tools.

DRAWING FIGURES

DESCRIPTION OF THE INVENTION

Figure 1:
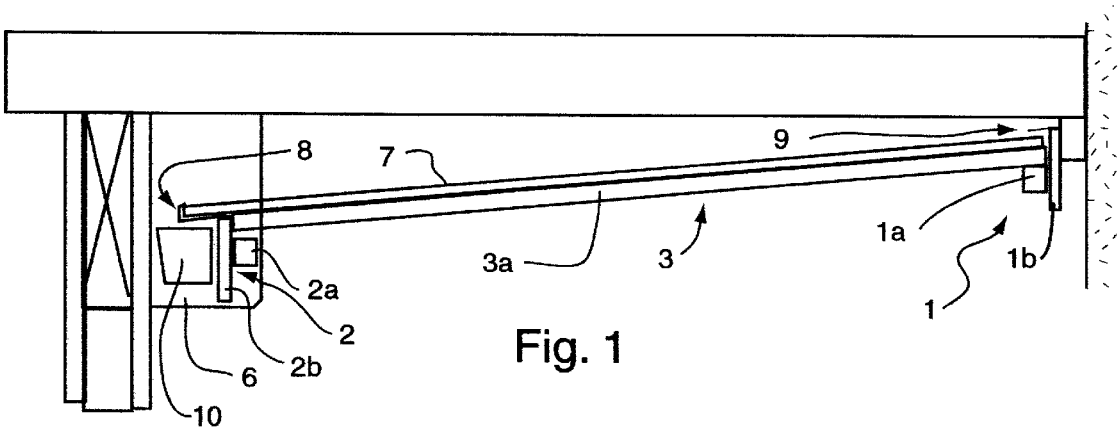
FIG. 1 is a profile of the invention.
Figure 2:
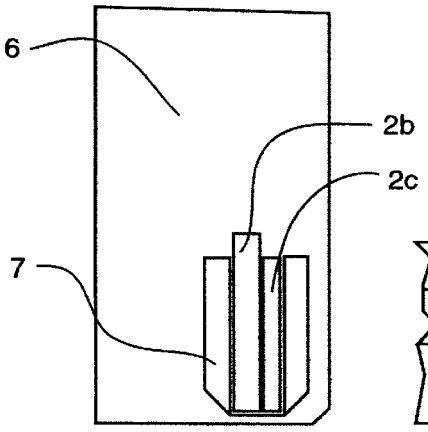
FIG. 2 & FIG. 3 are details of the low-ledger fitting into the joist of an endboard
Figure 3:
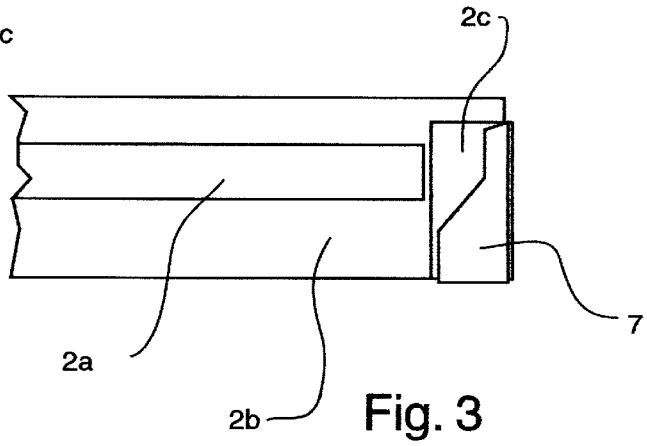
Figure 4:
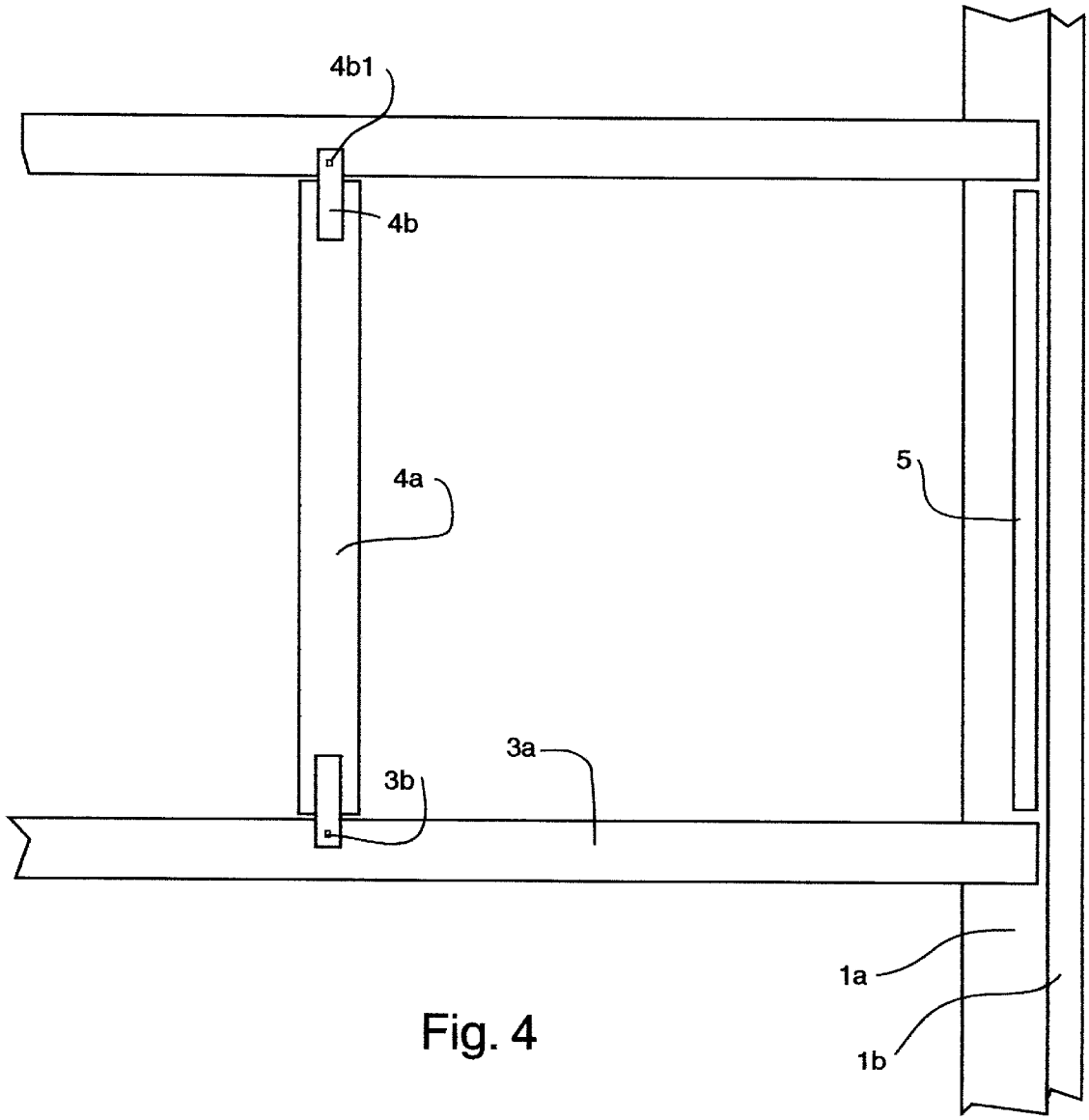
FIG. 4 shows how cross-members and spacers are disposed with the sloping members and the highledger, respectively.
Figure 5:
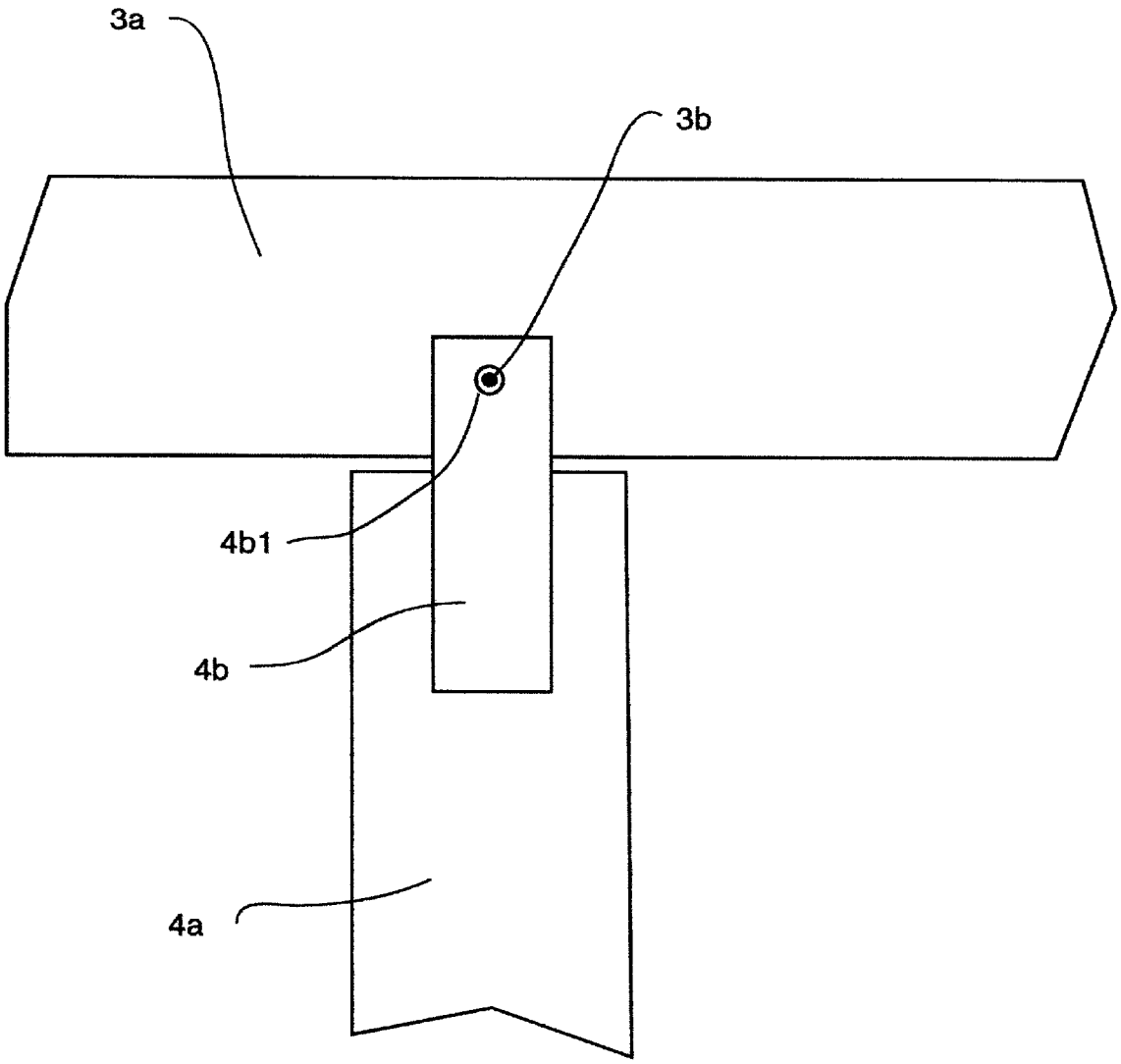
FIG. 5 is a detail of a cross-member bracket and how it is disposed.

Some specially made elements are common among several components. Nominal 2×2(s),hereinafter called 2×2(s) are constituents of the high-ledger, the low-ledger, as well as the elongated sloping members. The 2×2s are pre-manufactured by ripping 2×4s in half. They have actual dimension of about 1.5" by 1 11/16-inch and they have a smooth straight cut surface on one side. Nominal 1×2(s), hereinafter called 1×2(s) are constituents of the cross-members, spacers and trim. The 1×2s are pre-manufactured by ripping 2×2 fence pickets in half. They have actual dimension of about 1.5-inches by 9/16-inches, and they have a smooth straight cut surface on one side. Nominal 5/4 deck boards have actual dimensions of 1-inch×5.5-inches. All wood members are pressure treated and the 2×4s from which the 2×2s are cut are dried after treatment for increased stability.

The high-ledger 1 comprises a 2×2 1*a* fastened to the side of a 5/4×6 deck board 1*b*. The 2×2 extends the full length of the deck board. The cut side of the 2×2 faces upward, representing an upper-face, and is about 1.75-inches below the top of the deck board, the 1.75-inches of deck board representing an upstanding-face.

The low-ledger 2 comprises a 2×2 2*a* fastened to the side of a 5/4×6 deck board 2*b*. The 2×2 extends the full length of the deck board less about 2-inches at both ends. The cut side of the 2×2 faces upward, representing an upper-face, and is about 1.25-inches below the top of the deck board, the 1.25-inches of deck board representing an upstanding-face. Fillers 2*c*, comprising plates of ½-inch plywood, with about a 5-inch by 2-inch face area dimension are fastened to the side of the deck-board, one on each end and on the same side as the 2×2. The outside edges of the plates are roughly flush with the deck board at its ends and at its lower edge. The ends of the low-ledger fit snugly into the joist hanger 7 of endboards 6, one of which is disposed at each end of the low-ledger.

Each endboard 6 comprises 2 sheets of ¾-inch B/C plywood fastened together with screws and/or nails, the higher quality faces exposed, to make a 1.5-inch thick plate with a face dimensions of 10-inches wide by 16-inches long, the width extending horizontally, the length extending vertically. Each endboard is fastened to a deck joist using two 3.5-inch×¼-inch hex bolts with nuts and washers. Nominal 6-inch joist hangers 7 are disposed on a face of each endboard, ⅛-inch above the bottom edge of the endboard.

A plurality of elongated sloping members 3, each having two ends, are comprised of 2×2s 3*a* and finish nails 3*b*, with the cut sides of the 2×2s facing upwards, representing an upper-face. The 1 11/16-inch dimension of the sloping members normal to the upper-face, represent sides of the sloping members. The nails are finishing nails with a shaft of about 1/16-inch diameter and head of about ⅛-inch diameter. The nails are partially driven into the cut side so that nails protrude about ⅜" above the 2×2s, each nail representing a small projection above the upper-face. The nails are disposed approximately ¼ from the edges of the elongated sloping members every about 2-feet or less. One end, of each elongated sloping member rests on the 2×2, or the upper-face, of the high-ledger, the other end rests on the 2×2, or the upper-face, of the low-ledger. The sloping members are disposed perpendicularly to the low-ledger and generally uniformly about 20 to 24-inches on-center from each other generally about the full extent of the low-ledger.

A plurality of spacers 5, made from 1×2s and generally having a length of about 22⅜-inches are disposed at the high-ledger between the sloping members and fastened to the 5/4 board with two screws, the cut side facing the 5/4 board. The spacers are disposed so that their top edges are at the approximate same elevation as the top of the ends of the sloping members.

A plurality of cross-members 4*a*, is comprised of slats 4*a*, cut from 1×2s and generally having a length of 22⅜-inches, and of plastic brackets 4*b*. The brackets have a thickness of about ⅛-inch, representing a diminutive thickness, and a face dimension of about ¾-inches by 3-inches, each bracket with an upper-face and an under-side. The brackets are fastened to the cut face of the slats, one bracket at each end of each slat. The 3-inch dimension of each bracket extends parallel with the length of each slat and an edge of each bracket projects about ⅝-inches beyond each end of each stat. The 22⅜-inch slates represent a middle-portion of each cross-member. The ends of the slats and the approximate ⅝-inch projections, of the plastic brackets beyond the ends of each slat, represent end-portions of each cross-member. At each bracket, a hole, or a hollow, 4*b*1 having about a ⅛-inch diameter is drilled with its center disposed at the projected portion of the bracket, about ¼-inches from the edge of the slat, and at the approximate center of the ¾-inch dimension.

The cross-members are disposed perpendicularly to the sloping members, the cut side of the slats facing upwards, the brackets of the cross-members resting on the sloping members, the projecting nails of the sloping members project through the hollows of the brackets, holding the brackets in place. The upper-face and sides of the sloping members together with the small projections therefore represent an interface with the end-portions of the cross-members.

The cross-members in combination with the sloping members, the spacers, and the 5/4 board of the low-ledger form a substantially planer grid with a upper-surface. The high-ledger is at an elevation higher than the low-ledger such that the slope of each sloping members is down about ½-in per foot from its end at the high-ledger to its end at the low-ledger.

A plurality of corrugated plastic panels 7 rest on the upper-surface of the planer grid. Each panel has a nominal width of 2-feet and an actual width of about 26-inches. The panels are oriented so the rise and the fall of their corrugation is parallel to the low-ledger. The panels overlap about 2-inches, and are thus held to each other due to the corrugation. The panels extend approximately from the face of the 5/4 board of the high-ledger to about 2-inches beyond the 5/4 board at the low-ledger. The panels are held into place by clips 8 at the low-ledger and by flashing 9 at the high-ledger.

The clips 8 are made from ¾-inch by 4-inch strips of galvanized sheet metal. Each strip is bent along its long dimension ½-inch from one of its ends 90-degrees up, and bent at 1-inch from the same end 90-degrees up to produce a j-configuration, with a slot ½-inch deep and ½-inch wide. The clips are fastened by nail or screw to the upper-edge of the lower-ledger's 5/4 board generally one clip for each sloping members, in line with the sloping members, projecting horizontally about 1-inch beyond the upper-edge comer of the 5/4 board away from the sloping member. The clips represent a panel holding means in the proximity of the low-ledger.

The flashing 9 at the higher-side ledger is L-shaped, with the short leg about 1.75-inches long and the other leg about 2-inches long. The flashing is disposed with the short leg fastened to the face of the 5/4 board with the bend of the L-shaped flashing at about the same elevation as the upper edge of the 5/4 board, the long leg projecting over the spacer with a slightly downward slope. Generally the flashing extends the full length of the high-ledger. The flashing represents a panel holding means in the proximity of the high-ledger.

Having an aluminum gutter 10 with a flat side, the flat side is fastened, by screw, to the outside face of the 5/4 board of the lower-side fascia, about one screw per foot length of gutter. The flat side has a vertical dimension of about 3.5-inches. The screws are disposed about 1-inch form the top edge of the gutter's flat side. The gutter has a high-end and a low-end. The elevation of the gutter drops at least 1-inch in 20-feet from the high end to the low end. The upper-edge of the flat side at the gutter's high-end is at about the same elevation as the upper edge of the low-ledger's 5/4 board. The upper-edge of the flat side at the gutter's low end is up to a maximum of about 2-inches below the upper-edge of the flat side at the gutter's high end. A downspout protrudes from the gutter near its low end, at a post of the deck.

Other embodiments of the present invention are possible and preferred in some situations. Various plastic or sheet metal panels can be used. Fiber-reinforced plastic panels are preferred due to their lightness, stability and strength. The sloping members can be wood, metal, or plastic. Wood members are preferred mostly due to aesthetics. The equivalents of cross-members could be of wood, metal or plastics. One inexpensive embodiment is a plurality of metal j-beads, 2 to 10 feet long, with the two short legs notched out at the locations of the sloping members, with nails projecting from the sloping members to hold the j-beads in place. If looking for strength, another embodiment has been the use of 2×4s for sloping members, 2×6s with joist hangers replacing the low-ledger and the high-ledger.

In some situations it is preferable to attach a 2×2 to the side of the adjacent structure, in place of the high-ledger 5/4 board. In some situations it is preferable to eliminate the endboards, attaching the low-ledger directly to deck post, and providing a fascia board to hide the gutter. Where at beam or fascia board presents a flat surface, the gutter should be fastened to these rather than the low-ledger's 5/4 board to distribute the weight.

What is claimed is:

1. A shedding apparatus, for use under decks, the apparatus comprising a low-ledger, with an upper-face and an adjacent upstanding-face, said upstanding-face extending above said upper-face, with an upper-edge at the top of and extending normal to said upstanding-face, a high-ledger, with an upper-face and an adjacent upstanding-face, said upstanding-face extending above said upper-face, a plurality of sloping-members, each with an upper-face, a first-end, a second-end, and with one or more small projections from said upper-face, such as one or more partially driven nails, a plurality of cross-members, each cross-member comprising a middle-portion and two end-portions, each end-portion with an upper-face, the middle-portion with an upper-face and two ends, said upper-face of the middle-portion and said upper-faces of the end-portions practically co-planar, one or more panels having corrugations, a panels holding means, said low-ledger and said high-ledger adapted to be attached to a proximate structure, said low-ledger and said high-ledger oriented such that said upstanding-face of said high-ledger faces said upstanding-face of said low-ledger, said sloping-members disposed normal to said low-ledger, and each substantially extending from said upstanding-face of said low-ledger to said upstanding-face of said high-ledger, said first-end of each sloping-member resting upon said upper-face of said low-ledger, said second-end of each sloping-member resting upon said upper-face of said high-ledger, wherein said sloping-members can be positioned at generally uniform intervals along the ledgers, said cross-members generally parallel with said low-ledger, said middle-portions substantially extending from one sloping member to the next, said end-portions of said cross-members resting upon said upper-faces of said sloping-members, each end-portion proximate one or more said small projections of said sloping-member, wherein said cross-members interface with said projections and said sloping-members, wherein the end-portions of said cross-members are held by an interface with said sloping members, and wherein said sloping-members are laterally restrained, wherein a grid support structure is formed, whereby grid members can be snapped or set into position, unsnapped or lifted out of position without requiring tools for fastening or unfastening, whereby the grid can be installed, adjusted, and uninstalled from below itself, whereby the ease of installation and removal is facilitated, and whereby, access to the area above the grid for maintenance and other reasons is greatly facilitated, wherein the upper-faces of the cross-members are substantially co-planar, said panels resting upon said cross-members, oriented with rise and fall of corrugations normal to said low-ledger, said panels overlapping, wherein a substantially planer shedding surface is formed over the grid, whereby said panels can be set into position, shifted or lifted out of position without requiring tools for fastening or unfastening, whereby the panels can be installed and uninstalled from below, whereby the ease of installation and removal is facilitated, and whereby, access to the area above the panels for maintenance and other reasons is greatly facilitated.

2. Said shedding apparatus of claim 1, wherein said low-ledger comprises a 2×2 fastened to the face of a deckboard, whereby said low-ledger can be proficiently manufactured from wood and is aesthetically pleasing in a deck environment.

3. Said shedding apparatus of claim 1, wherein said high-ledger comprises a 2×2 fastened to the face of a deckboard, whereby said low-ledger can be proficiently manufactured from wood and is aesthetically pleasing in a deck environment.

4. Said shedding apparatus of claim 1, wherein said sloping-member comprises a 2×2 with said small projections, whereby said sloping-member can be proficiently manufactured from wood and is aesthetically pleasing in a deck environment.

5. Said shedding apparatus of claim 4, wherein said small projection of said sloping member is a partially driven nail.

6. Said shedding apparatus of claim 1, wherein said end-portion of said cross-member is of diminutive thickness, wherein said upper-surface of said sloping-member and said upper-surface of said cross-member are substantially co-planer, wherein the vertical height of the grid is reduced providing a sleeker profile, whereby the appearance of the awning from outside and below is less obtrusive and aesthetically pleasing.

7. Said shedding apparatus of claim 6, wherein said-cross-member comprises a wood slat with a plastic bracket at each end, whereby said cross-member can be proficiently manufactured from wood and plastic brackets, and is aesthetically pleasing in a deck environment.

8. Said shedding apparatus of claim 7, wherein said plastic bracket is ⅛" pvc with a hollow, wherein said hollow of said plastic bracket is fitted around said projection of said sloping member.

9. Said shedding apparatus of claim 1, wherein said panel holding means is a panel clip.

10. Said shedding apparatus of claim 1, further comprising a spacer, said spacer comprising a wood slat and a fastening means, wherein the spacer is fastened to the upstanding face of the high-ledger, whereby each spacer effectively replaces a cross-member, and whereby said sloping-member is laterally constrained by said spacer, yet said sloping member can be lifted out and re-set into position without use of tools.

11. Said shedding apparatus of claim 1, further comprising flashing at at the high-ledger as a panel holding means.

12. Said shedding apparatus of claim 1 further comprising a fascia-board.

13. Said shedding apparatus of claim 1 further comprising a gutter and downspout.

14. Said shedding apparatus of claim 1 further comprising endboards, said endboard comprising a joist hanger and a plate with a face, said joist hanger fastened to said face of said plate, said plate adapted to be fastened to a proximate structure, wherein said low-ledger or said high-ledger sets in said joist hanger, whereby the ledger can be set into and lifted out of said joist hanger without fastening or use of tools.

15. A grid apparatus for supporting panels, the apparatus comprising a low-ledger, with an upper-face and an adjacent upstanding-face, said upstanding-face extending above said upper-face, with an upper-edge at the top of and extending normal to said upstanding-face, a high-ledger, with an upper-face and an adjacent upstanding-face, said upstanding-face extending above said upper-face, a plurality of sloping-members, each with an upper-face, a first-end, a second-end, and with one or more small projections from said upper-face, such as one or more partially driven nails one or more cross-members, each cross-member comprising a middle-portion and two end-portions, the middle-portion with an upper-face and two ends, each end-portion with an upper-face and an under-side, said upper-face of the middle-portion and said upper-faces of the end-portions practically co-planar, said low-ledger and said high-ledger oriented such that said upstanding-face of said high-ledger faces said upstanding-face of said low-ledger, said sloping-members disposed normal to said low-ledger, and each substantially extending from said upstanding-face of said low-ledger to said upstanding-face of said high-ledger, said first-end of each sloping-member resting upon said upper-face of said low-ledger and said second-end of each sloping-member resting upon said upper-face of said high-ledger, said cross-members generally parallel with said low-ledger, said middle-portions substantially extending from one sloping member to the next, said end-portions of said cross-members resting upon said upper-faces said sloping-members, each end-portion proximate one or more said small projections of said sloping-member, making an interface as a holding means, wherein a grid structure is formed, with a substantially co-planer upper-surface is formed, whereby the grid members can be snapped or set into position, unsnapped or lifted out of position without requiring tools for fastening or unfastening, whereby the grid can be installed, adjusted, and uninstalled from below, whereby the ease of installation and removal is facilitated, and whereby, access to the area above the grid for maintenance and other reasons is greatly facilitated, wherein the upper surfaces of the cross-members are substantially co-planar, whereby providing a support surface for panels.

* * * * *